US008272308B1

(12) United States Patent
Lukman et al.

(10) Patent No.: US 8,272,308 B1
(45) Date of Patent: Sep. 25, 2012

(54) SINGLE-ACTION FEED DISENGAGE MECHANISM FOR WEAPON

(75) Inventors: Hansen Lukman, Parsippany, NJ (US); Adam M. Jacob, Brodheadsville, PA (US); Curtis D. Johnson, Montrose, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 385 days.

(21) Appl. No.: 12/764,235

(22) Filed: Apr. 21, 2010

(51) Int. Cl.
*F41A 9/00* (2006.01)

(52) U.S. Cl. ..... 89/33.2; 89/33.25

(58) Field of Classification Search ..... 89/33.01, 89/33.2, 33.25, 33.14, 33.16
See application file for complete search history.

(56) References Cited

U.S. PATENT DOCUMENTS

| | | | | |
|---|---|---|---|---|
| 2,375,219 | A * | 5/1945 | Gentry et al. | 89/33.25 |
| 3,362,293 | A * | 1/1968 | Jafvert | 89/33.1 |
| 3,999,461 | A * | 12/1976 | Johnson et al. | 89/191.01 |
| 4,004,489 | A * | 1/1977 | Johnson et al. | 89/33.04 |
| 4,061,074 | A * | 12/1977 | Johnson et al. | 89/33.25 |
| 6,681,677 | B2 * | 1/2004 | Herring | 89/33.14 |

* cited by examiner

*Primary Examiner* — Gabriel Klein
(74) *Attorney, Agent, or Firm* — Michael C. Sachs

(57) ABSTRACT

A feed disengage mechanism for a weapon with a sprocket-type feed system may include a sprocket rotatably fixed to the receiver. A forward pawl may be selectably engageable with a forward end of the sprocket. The forward pawl may include a flange and be biased for engagement with the sprocket. An anti-backup pawl may be selectably engageable with a rear end of the sprocket. The anti-backup pawl may include a cam path and be biased for engagement with the sprocket. A feed cover may include a feed slide assembly that may be translatable in a slot in the feed cover. The feed slide assembly may include a front pin engageable with the flange of the forward pawl and a rear pin engageable with the cam path of the anti-backup pawl.

18 Claims, 7 Drawing Sheets

SINGLE-ACTION FEED DISENGAGE MECHANISM FOR WEAPON

STATEMENT OF GOVERNMENT INTEREST

The inventions described herein may be manufactured, used and licensed by or for the U.S. Government for U.S. Government purposes.

BACKGROUND OF THE INVENTION

The invention relates, in general, to weapons, and, in particular, to the loading and unloading of belted ammunition.

Weapons, such as, for example, machine guns, may have sprocket-type ammunition feed systems. Weapons with fixed-axis sprocket feed systems may require pawls that convert the bi-directional movement of the operating group to a one-way rotational movement of the sprocket. Two pawls may achieve a ratcheting movement that allows the sprocket to turn in only one direction, to index the next ammunition. Therefore, loading and unloading of the ammunition belt may require that the pawls be disengaged from the sprocket, so that the sprocket may freely rotate.

SUMMARY OF THE INVENTION

It is an object of the invention to provide an apparatus for a weapon that may disengage the feed system pawls and open the feed cover of the weapon.

It is another object of the invention to provide a weapon including an apparatus that may disengage the feed system pawls and open the feed cover of the weapon.

In one aspect of the invention, a weapon may include a barrel fixed to a receiver; a sprocket rotatably fixed to the receiver and having a longitudinal axis substantially parallel to a longitudinal axis of the barrel; a forward pawl selectably engageable with a forward end of the sprocket and reciprocable along the longitudinal axis of the sprocket, the forward pawl including a flange and being biased for engagement with the sprocket; an anti-backup pawl selectably engageable with a rear end of the sprocket and reciprocable along the longitudinal axis of the sprocket, the anti-backup pawl including a cam path and being biased for engagement with the sprocket; a feed cover rotatable about the longitudinal axis of the sprocket; and a feed slide assembly slidably engaged with the feed cover, the feed slide assembly including a front pin engageable with the flange of the forward pawl and a rear pin engageable with the cam path of the anti-backup pawl.

In another aspect of the invention, a method may include providing the weapon described above, and disengaging the forward pawl from the sprocket by translating the feed slide assembly forward. The method may include, after disengaging the forward pawl, disengaging the anti-backup pawl by rotating the feed slide assembly.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

A single-action feed disengage mechanism may facilitate the loading and unloading of belted ammunition for weapons with sprocket-type feed systems. The single-action feed disengage mechanism may simultaneously achieve the functions of disengaging the pawls and opening the feed cover, in two motions.

Figure 1:
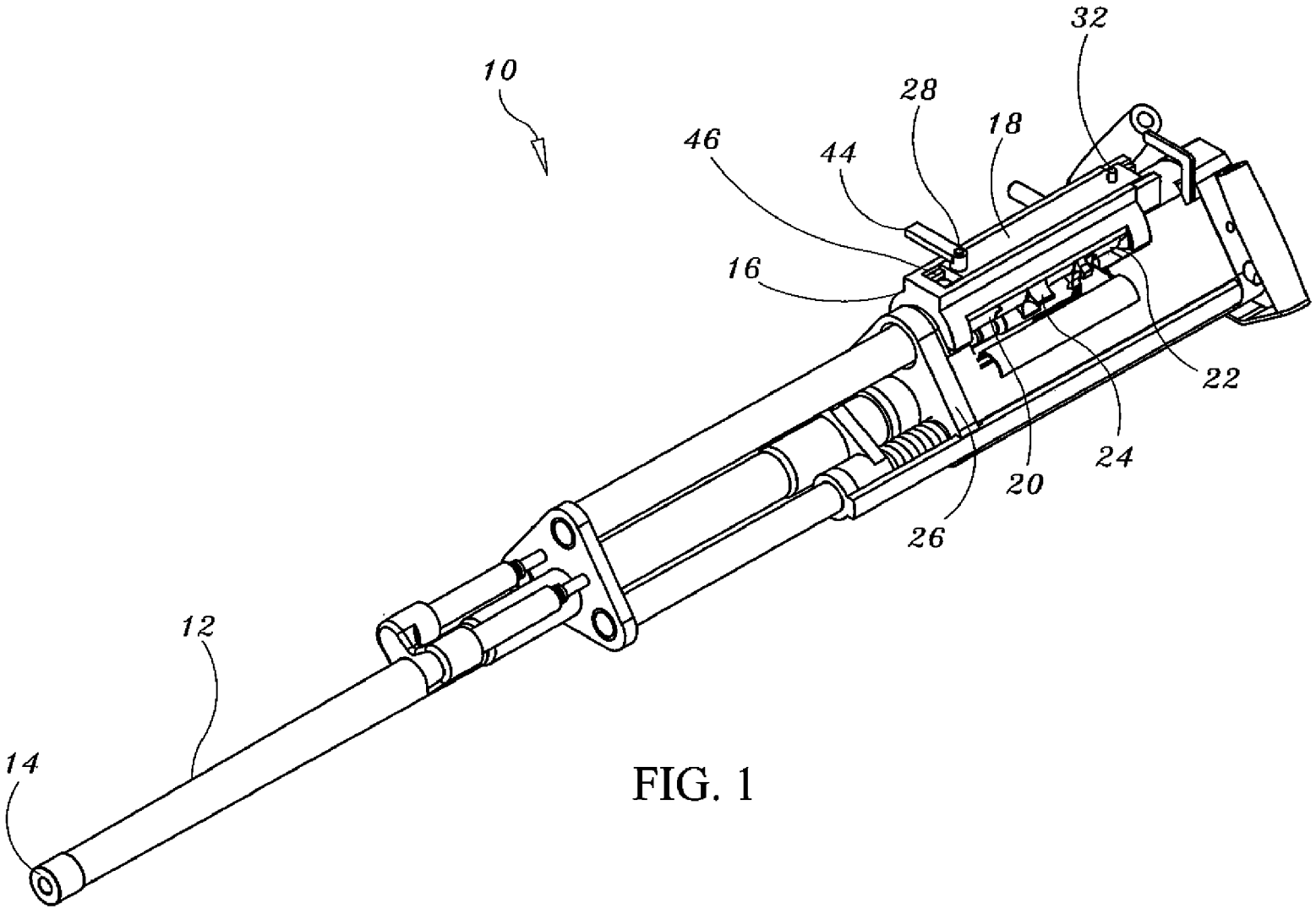
FIG. 1 is a front perspective view of an embodiment of a weapon with a single- action feed disengage mechanism.
Figure 2:
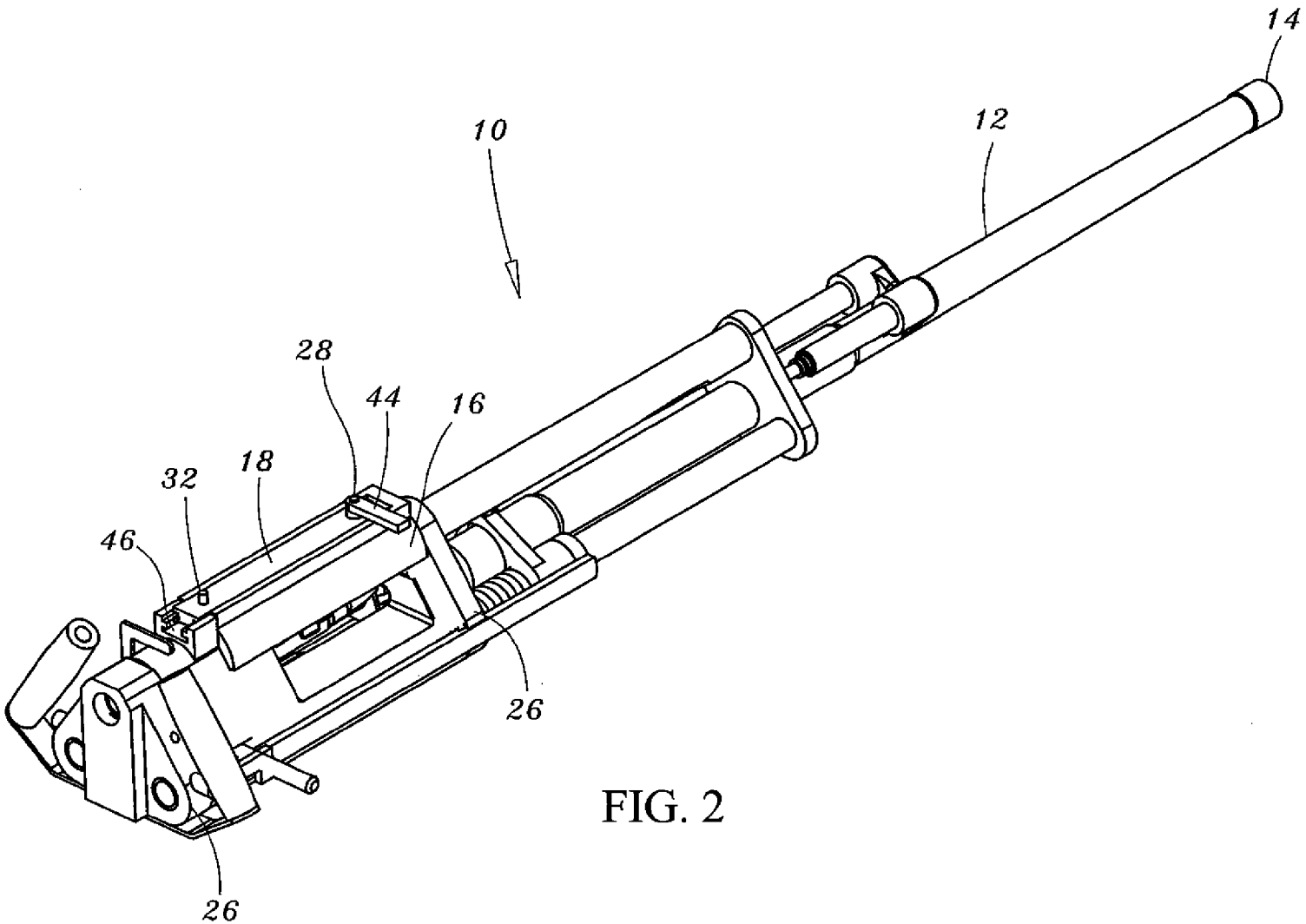
FIG. 2 is a rear perspective view of the weapon of FIG. 1.

FIGS. 1 and 2 are front and rear perspective views, respectively of an embodiment of a weapon 10 with a single-action feed disengage mechanism. Weapon 10 may include a barrel 12 fixed to a receiver 26. Barrel 12 may have a muzzle 14. As used herein, the "front" of the weapon 10 refers to the muzzle end.

Figure 3:
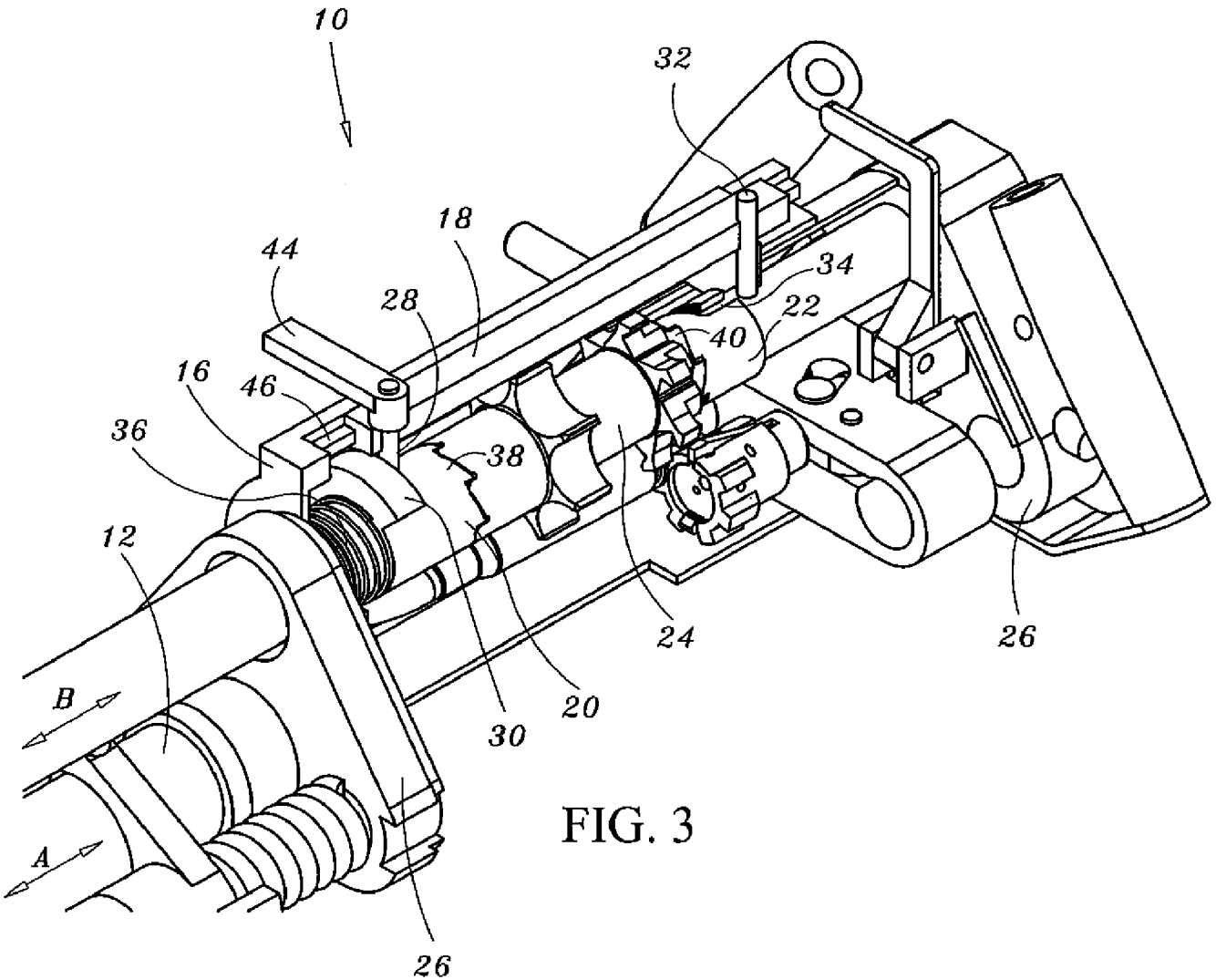
FIG. 3 is an enlarged, cutaway view of the receiver end of the weapon of FIG. 1.

FIG. 3 is an enlarged, cutaway view of the receiver end of the weapon 10 of FIG. 1. As seen in FIG. 3, a sprocket 24 may be rotatably fixed to the receiver 26. Sprocket 24 may have a longitudinal axis B that is substantially parallel to a longitudinal axis A of the barrel 12. A forward pawl 20 may be selectably engageable with a forward end 38 of the sprocket 24. Forward pawl 20 may be reciprocable along the longitudinal axis B of the sprocket 24. The forward pawl 20 may include a flange 30. Forward pawl 20 may be biased for engagement with the sprocket 24. A spring 36 may be disposed between flange 30 and a portion of receiver 26 to provide the bias for the forward pawl 20.

An anti-backup pawl 22 may be selectably engageable with a rear end 40 of the sprocket 24. Anti-backup pawl 22 may be reciprocable along the longitudinal axis B of the sprocket 24. The anti-backup pawl 22 may include a cam path 34. Anti-backup pawl 22 may be biased for engagement with the sprocket 24. A spring 42 may be disposed between a protrusion 48 (FIG. 4C) on the anti-backup pawl 22 and an inner surface of a stationary plate 50 (FIG. 4C) to provide the bias for the anti-backup pawl 22.

A feed cover 16, shown in full in FIGS. 1 and 2, is shown partially cut away in FIG. 3. Feed cover 16 may be rotatable about the longitudinal axis B of the sprocket 24. A feed slide assembly 18, shown in full in FIGS. 1 and 2, is shown partially cut away in FIG. 3. The feed slide assembly 18 may be translatable in a slot 46 in feed cover 16. The feed slide assembly 18 may include a front pin 28 that may abut the rear side of flange 30 of the forward pawl 20. The feed slide assembly 18 may include a rear pin 32 that may be engageable with the cam path 34 of the anti-backup pawl 22. The feed slide assembly 18 may rotate with the feed cover 16.

A handle 44 may be fixed to the front pin 28. A weapon operator may use handle 44 to translate feed slide assembly 18.

Figure 4A:
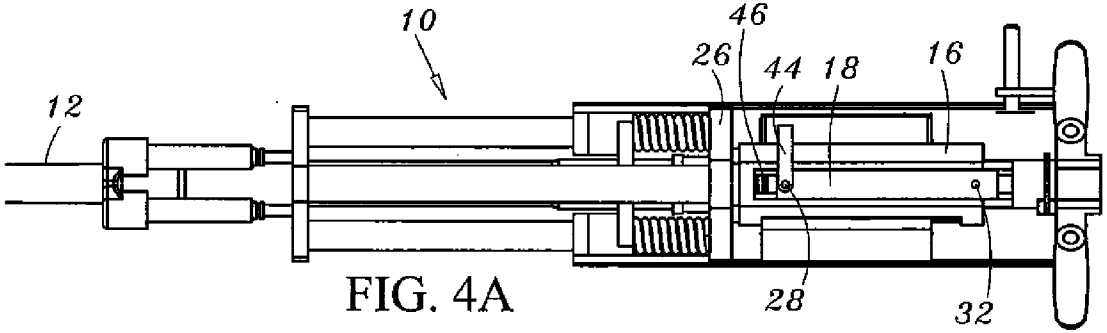
FIGS. 4A-C are top, side, and side cutaway views, respectively, of the weapon of FIG. 1 with the feed sprocket engaged.
Figure 4B:
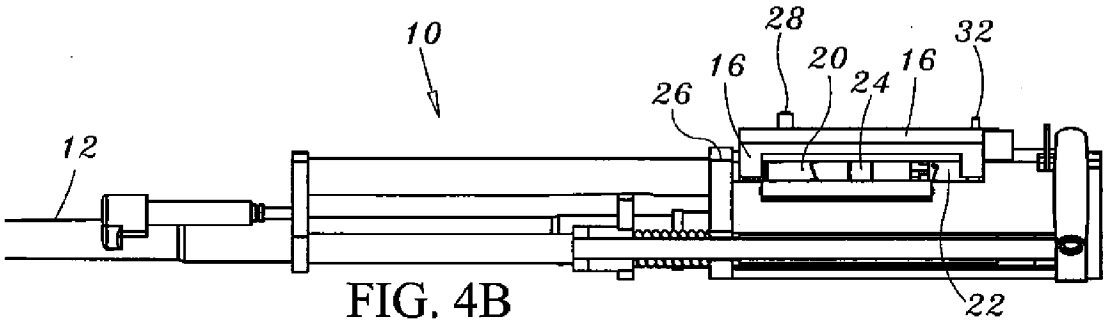
Figure 4C:
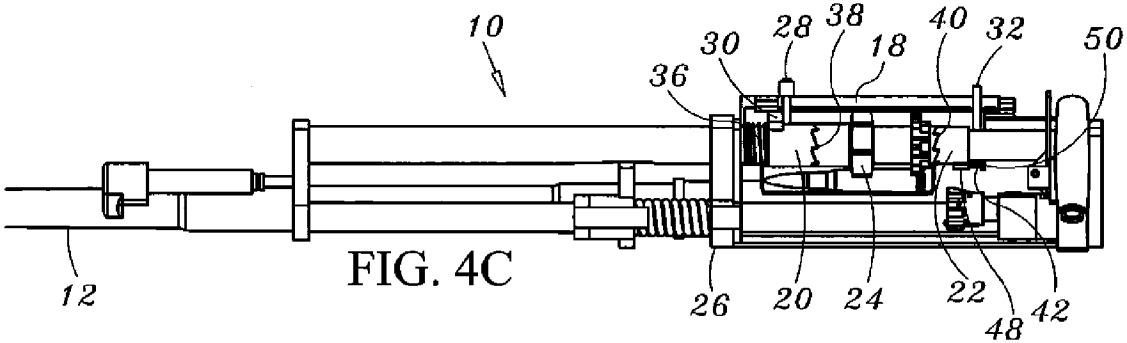

FIGS. 4A-C are top, side, and side cutaway views, respectively, of the weapon 10 of FIG. 1 with the feed sprocket 24 engaged with both the forward pawl 20 and the anti-backup pawl 22. In FIGS. 4A-C, the weapon 10 is configured for firing. The feed cover 16 is in a closed position to protect the sprocket 24 and the forward and anti-backup pawls 20, 22. The feed slide assembly 18 is positioned rearward.

Figure 5A:
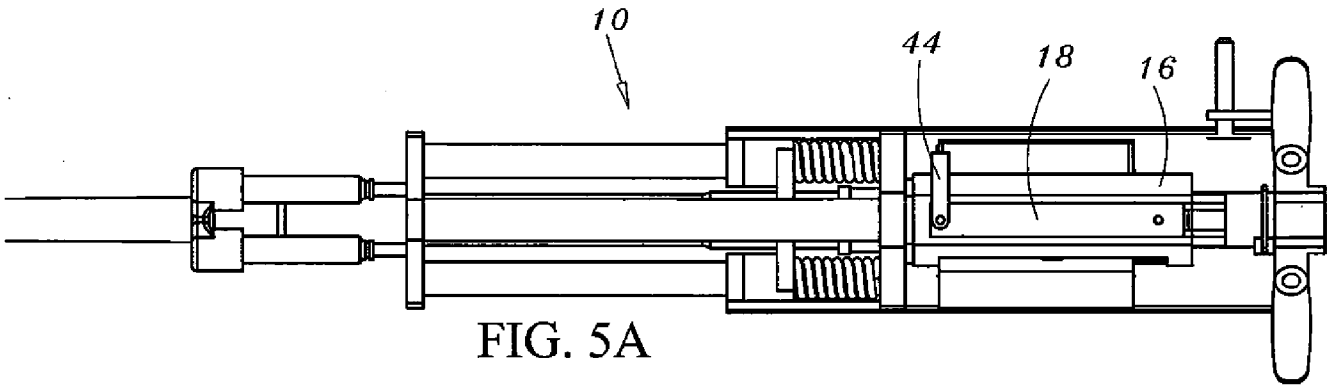
FIGS. 5A-C are top, side, and side cutaway views, respectively, of the weapon of FIG. 1 showing a first motion of the feed disengage mechanism.
Figure 5B:
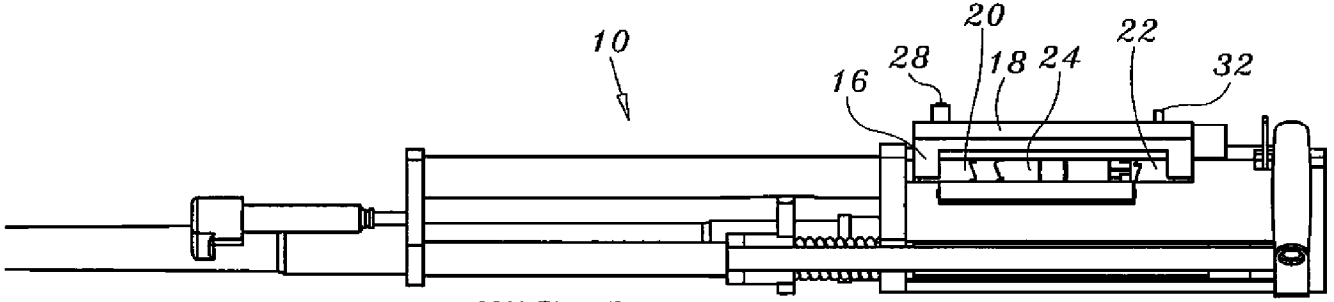
Figure 5C:
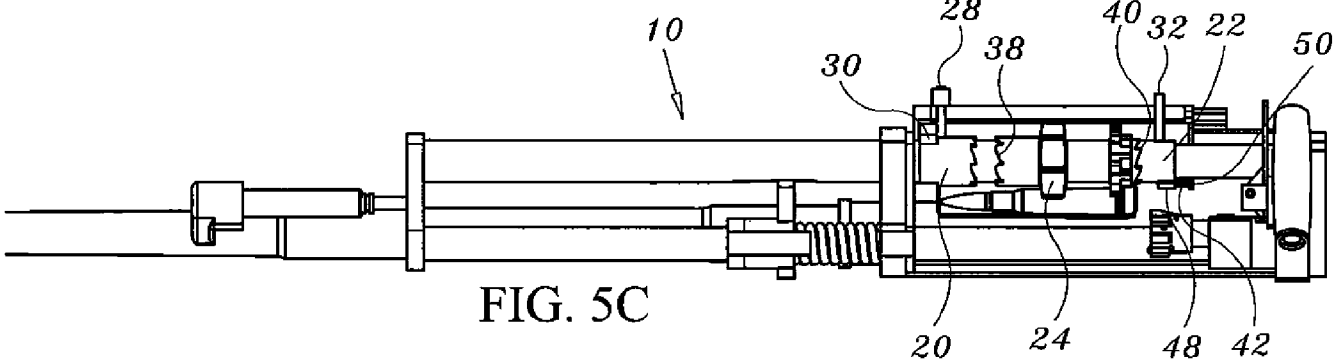

FIGS. 5A-C are top, side, and side cutaway views, respectively, of the weapon 10 of FIG. 1 showing a first motion of the feed disengage mechanism. The weapon user translates the feed slide assembly 18 forward by grasping or pushing on handle 44. As the feed slide assembly 18 moves forward, front pin 28 pushes against flange 30, thereby compressing spring 36 and moving forward pawl 20 forward and out of engagement with sprocket 24. At the same time, the rear pin 32 moves into the cam-path 34 (FIGS. 3 and 7) of the anti-backup pawl 22.

Figure 6A:
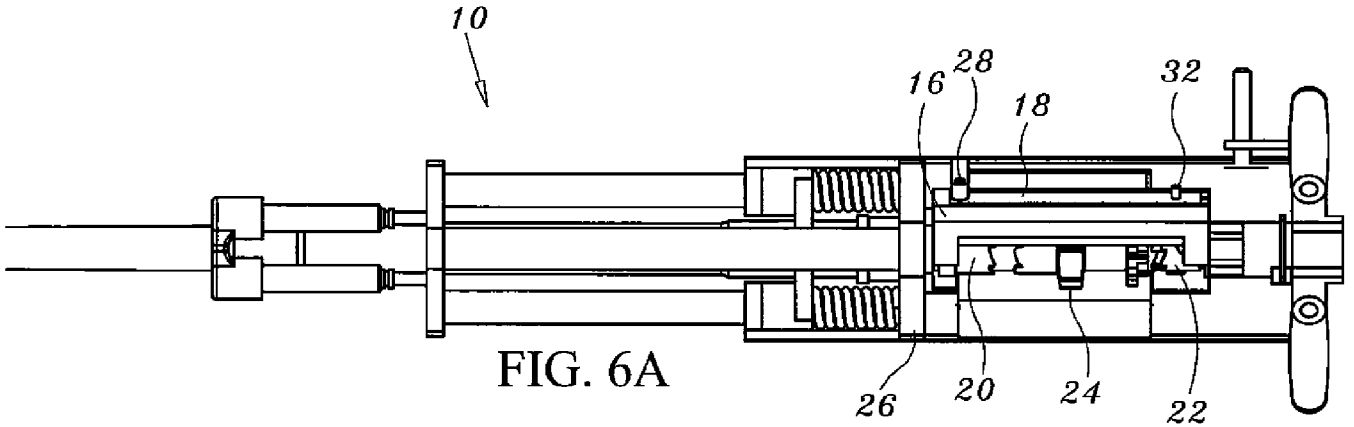
FIGS. 6A-C are top, side, and side cutaway views, respectively, of the weapon of FIG. 1 showing a second motion of the feed disengage mechanism.
Figure 6B:
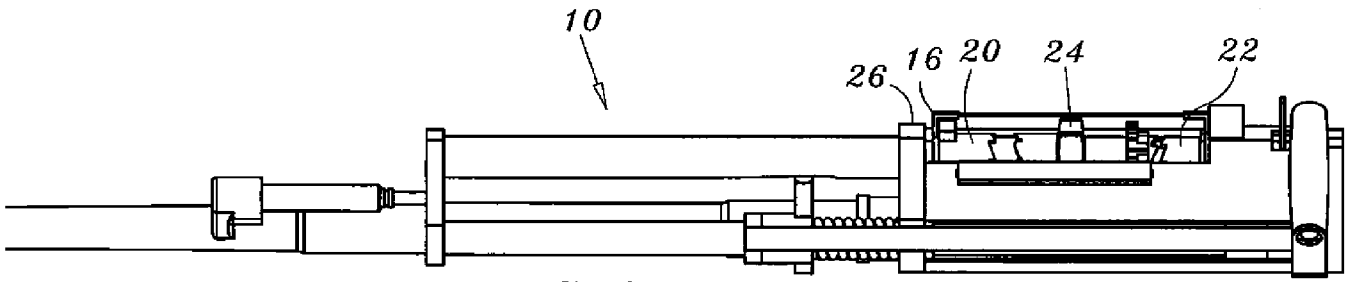
Figure 6C:
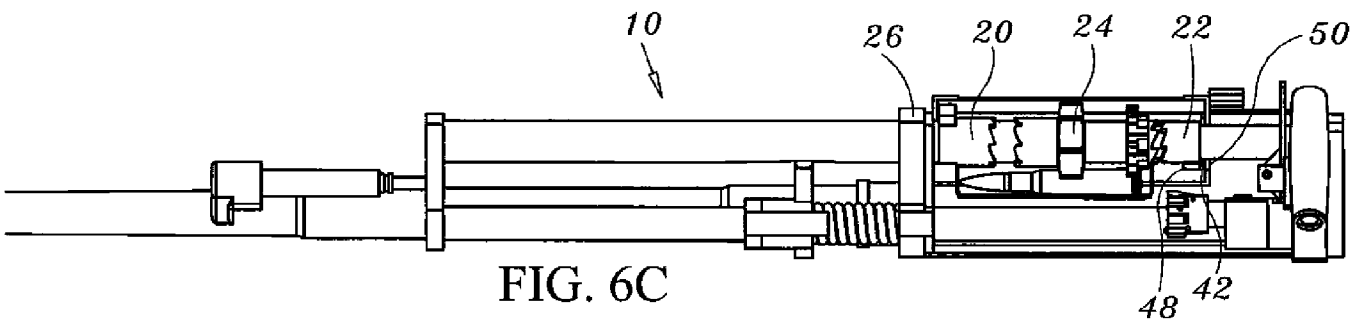

FIGS. 6A-C are top, side, and side cutaway views, respectively, of the weapon 10 of FIG. 1 showing a second motion of the feed disengage mechanism. With the feed slide assembly 18 in the forward position, as shown in FIGS. 5A-C, the feed cover 16 may be rotated to expose the sprocket 24. In FIGS. 6A-C, the direction of rotation of the feed cover 16 is clockwise, if one were at the rear of the weapon 10 and facing forward. Rotating the feed cover 16 to the open position translates the anti-backup pawl 22 rearward due to the movement of the rear pin 32 in the cam path 34 (FIG. 3). Rearward movement of the anti-backup pawl 22 compresses spring 42. With both the forward and anti-backup pawls 20, 22 disengaged, as shown in FIGS. 6A-C, the sprocket 24 is free to rotate with the feed cover 16 in the open position.

Figure 7:
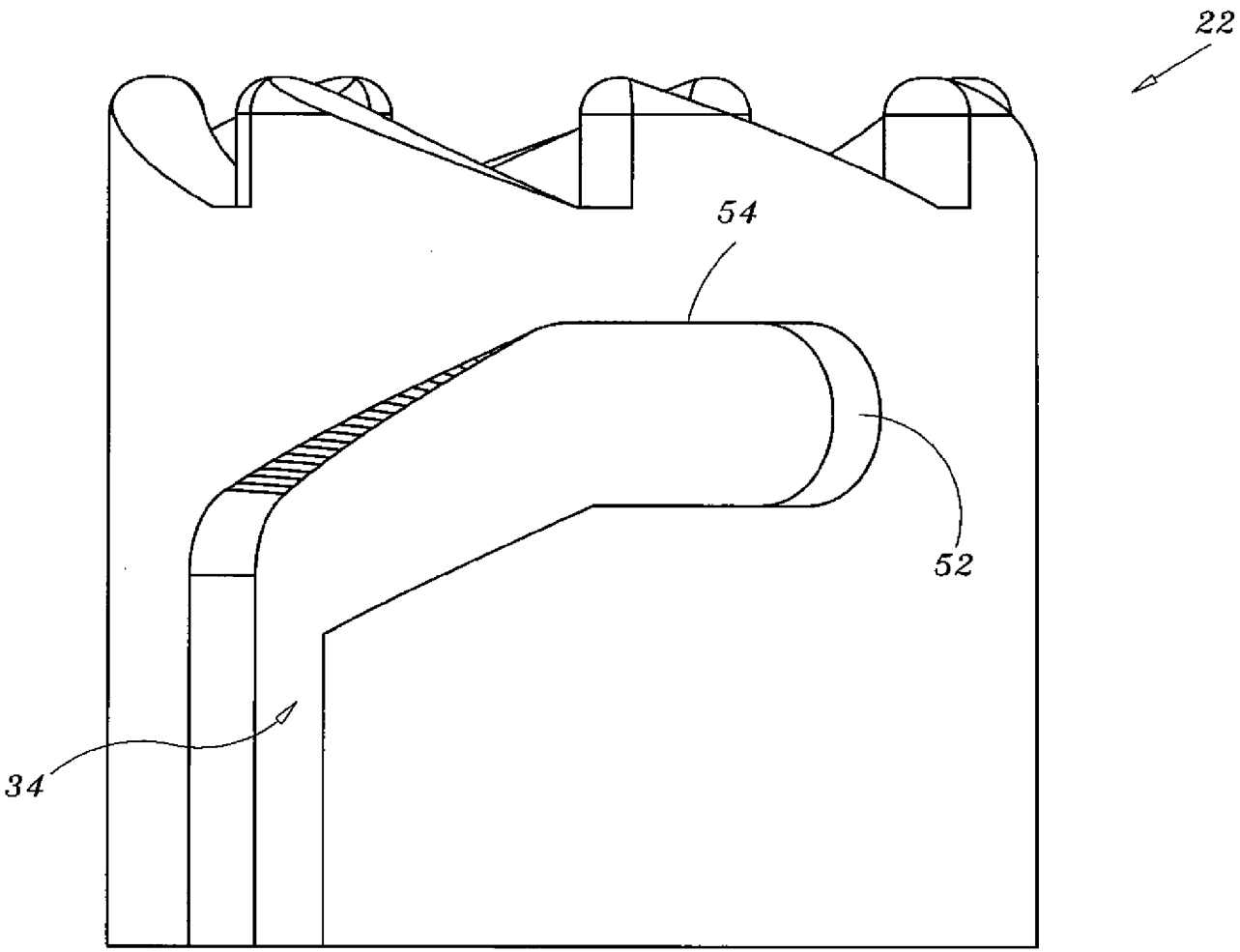
FIG. 7 is a side view of an embodiment of an anti-backup pawl.

The forward and anti-backup pawls 20, 22 may be locked in the disengaged position of FIGS. 6A-C by the rear pin 32 in cam path 34. FIG. 7 is a side view of an embodiment of an anti-backup pawl 22 with a cam path 34. The orientation of anti-backup pawl 22 shown in FIG. 7 is as if the weapon 10 were pointed vertically. When rear pin 32 reaches the end 52 of cam path 34, the rear pin 32 bears against the cam path surface 54, preventing the feed slide assembly 18 from moving rearward.

The forward and the anti-backup pawls 20, 22 may be unlocked from the disengaged position by rotating the feed slide assembly 18 in a direction opposite a direction of rotation for locking the forward and anti-backup pawls 20, 22 in the disengaged position. After unlocking the forward and anti-backup pawls 20, 22, the forward pawl 20 may be re-engaged with the sprocket 24 by translating the feed slide assembly 18 rearward.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A weapon, comprising:

a barrel fixed to a receiver;

a sprocket rotatably fixed to the receiver and having a longitudinal axis substantially parallel to a longitudinal axis of the barrel;

a forward pawl selectably engageable with a forward end of the sprocket and reciprocable along the longitudinal axis of the sprocket, the forward pawl including a flange and being biased for engagement with the sprocket;

an anti-backup pawl selectably engageable with a rear end of the sprocket and reciprocable along the longitudinal axis of the sprocket, the anti-backup pawl including a cam path and being biased for engagement with the sprocket;

a feed cover rotatable about the longitudinal axis of the sprocket; and a feed slide assembly slidably engaged with the feed cover, the feed slide assembly including a front pin engageable with the flange of the forward pawl and a rear pin engageable with the cam path of the anti-backup pawl.

2. The weapon of claim 1, wherein the feed slide assembly rotates with the feed cover.

3. The weapon of claim 1, wherein a forward movement of the feed slide assembly disengages the forward pawl from the sprocket.

4. The weapon of claim 3, wherein the forward movement of the feed slide assembly engages the rear pin with the cam path of the anti-backup pawl.

5. The weapon of claim 3, wherein a rotational movement of the feed slide assembly disengages the anti-backup pawl from the sprocket.

6. The weapon of claim 5, wherein the rotational movement of the feed side assembly moves the rear pin in the cam path to thereby disengage the anti-backup pawl from the sprocket.

7. The weapon of claim 1, wherein the forward pawl is biased for engagement with the sprocket using a spring.

8. The weapon of claim 7, wherein the spring is disposed between a front end of the flange and a portion of the receiver.

9. The weapon of claim 1, wherein the anti-backup pawl is biased for engagement with the sprocket using a second spring.

10. The weapon of claim 9, wherein the second spring is disposed between the anti-backup pawl and a stationary plate.

11. The weapon of claim 1, further comprising a handle fixed to the front pin for moving the feed slide assembly.

12. The weapon of claim 1, wherein the feed slide assembly is slidable in a slot in the feed cover.

13. A method, comprising:

providing the weapon of claim 1; and disengaging the forward pawl from the sprocket by translating the feed slide assembly forward.

14. The method of claim 13, further comprising, after disengaging the forward pawl, disengaging the anti-backup pawl by rotating the feed slide assembly.

15. The method of claim 14, wherein rotating the feed slide assembly includes moving the rear pin in the cam path of the anti-backup pawl.

16. The method of claim 14, further comprising, after disengaging the anti-backup pawl, locking the forward and the anti-backup pawls in a disengaged position.

17. The method of claim 16, further comprising, after locking the forward and the anti-backup pawls, unlocking the forward and anti-backup pawls from the disengaged position by rotating the feed slide assembly in a direction opposite a direction of rotation for locking the forward and anti-backup pawls in the disengaged position.

18. The method of claim 17, further comprising, after unlocking the forward and anti-backup pawls, engaging the forward pawl with the sprocket by translating the feed slide assembly rearward.

* * * * *